United States Patent [19]

Pelczarski

[11] Patent Number: 4,648,679

[45] Date of Patent: Mar. 10, 1987

[54] CONNECTOR ASSEMBLY FOR MASS TERMINATION

[75] Inventor: Walter J. Pelczarski, Downers Grove, Ill.

[73] Assignee: Allied Corporation, Morristown, N.J.

[21] Appl. No.: 798,531

[22] Filed: Nov. 15, 1985

[51] Int. Cl.[4] ..... H01R 4/24

[52] U.S. Cl. ..... 339/99 R; 339/223 R

[58] Field of Search ..... 339/97 R, 97 P, 98, 339/99, 223

[56] References Cited

U.S. PATENT DOCUMENTS

| | | | |
|---|---|---|---|
| 3,902,154 | 8/1975 | McKee | 339/223 R |
| 3,950,065 | 4/1976 | Renn | 339/98 |
| 4,018,177 | 4/1977 | McKee et al. | 113/119 |
| 4,035,049 | 7/1977 | McKee | 339/97 R |
| 4,040,702 | 8/1977 | McKee et al. | 339/97 R |
| 4,050,760 | 9/1977 | Cohen | 339/97 R |
| 4,191,442 | 3/1980 | Caveney et al. | 339/99 R |
| 4,243,286 | 1/1981 | Brown et al. | 339/97 R |
| 4,243,288 | 1/1981 | Lucius et al. | 339/99 M |
| 4,277,124 | 7/1981 | Loose et al. | 339/99 R |
| 4,344,665 | 8/1982 | Racilla et al. | 339/99 R |
| 4,373,769 | 2/1983 | Mathe et al. | 339/97 R |
| 4,385,794 | 5/1983 | Lucius | 339/97 R |
| 4,435,035 | 3/1984 | Berry et al. | 339/99 R |
| 4,491,379 | 1/1985 | Brown et al. | 339/97 P |

FOREIGN PATENT DOCUMENTS 0087894 9/1983 European Pat. Off. .

*Primary Examiner*—Joseph H. McGlynn
*Attorney, Agent, or Firm*—C. D. Lacina

[57] ABSTRACT

A solderless terminal for electrically and mechanically terminating an insulated wire includes a U-shaped channel including a wire retention portion comprising a wire receiving opening having a wire engaging means formed integrally therewith and means to compress the wire engaging means into engagement with a circumferential longitudinal portion of the wire whereby to maintain that engagement.

5 Claims, 9 Drawing Figures

CONNECTOR ASSEMBLY FOR MASS TERMINATION

This invention relates to a connector assembly for mass terminating conductors into respective terminals and, in particular, to an arrangement for strain relieving the terminated conductors.

There is a constant need to provide more efficient and cost productive methods for mass terminating multiple conductors in a single operation. It is not always cost efficient to crimp individual terminals on individual conductors and then individually load the terminated conductors into restrictive cavities in a housing. It is known to provide a connector assembly that includes a housing and a plurality of insulation displacement terminals, the housing having a plurality of terminal passages that are enclosed but open onto a front mating face and are open and accessible adjacent the rear face whereat a wire may be stuffed downwardly and into an insulation displacing slot of each respective terminal. In U.S. Pat. No. 4,243,288 "Connector Assembly for Mass Termination" issuing Jan. 6, 1981 to Lucius et al, a pair of conductor engaging ears are deformed downwardly and about the wire to nonreleasably strain relieve the termination between the wire in the terminal. While possibly suitable for the uses intended, such an operation requires apparatus for bending the ears. It would be desirable to have a connector assembly including terminals which do not require special metal deforming dies and special apparatus for strain relieving the mass terminated assembly.

The present invention provides an electrical connector assembly for mass terminating each of a plurality of insulated wires with a respective plurality of conductive solderless terminals, the connector including a dielectric housing having a plurality of passages extending in a single row from a rear face through the housing to open on the mating face, each of the passages receiving a terminal and being openly accessible at the rear face remote from the mating face. Each terminal is U-shaped and axially spaces a wire restraint portion from an insulation displacement portion, each portion being disposed within the openly accessible portion of the housing.

In accordance with this invention, the solderless terminal for electrically and mechanically terminating the insulated wire is characterized by a U-shaped channel including a wire retention portion comprising a constricted wire receiving opening having wire engaging means formed integrally therewith and means to compress the wire engaging means into engagement with a longitudinally extending circumferential portion of the wire and to maintain that engagement. The means to compress comprises the channel including a base having a pair of longitudinally extending sidewalls resiliently connected thereto, and the wire engaging means comprises a pair of ribs each extending laterally towards the other from one respective sidewall and dovetailing downwardly towards the base to form the constricted wire receiving opening, the sidewalls being laterally spaced apart by an amount substantially that defined by the outer periphery of the wire and each rib including an engagement surface which faces the base and which is adapted to engage the outer periphery of the wire inserted downwardly between the ribs.

Advantageously, such a wire restraint will resist angular forces placed onto the wire and which will disturb the wire termination within the insulation displacement portion.

The invention will now be described, by way of example, with reference to the accompanying drawings in which.

Figure 1:
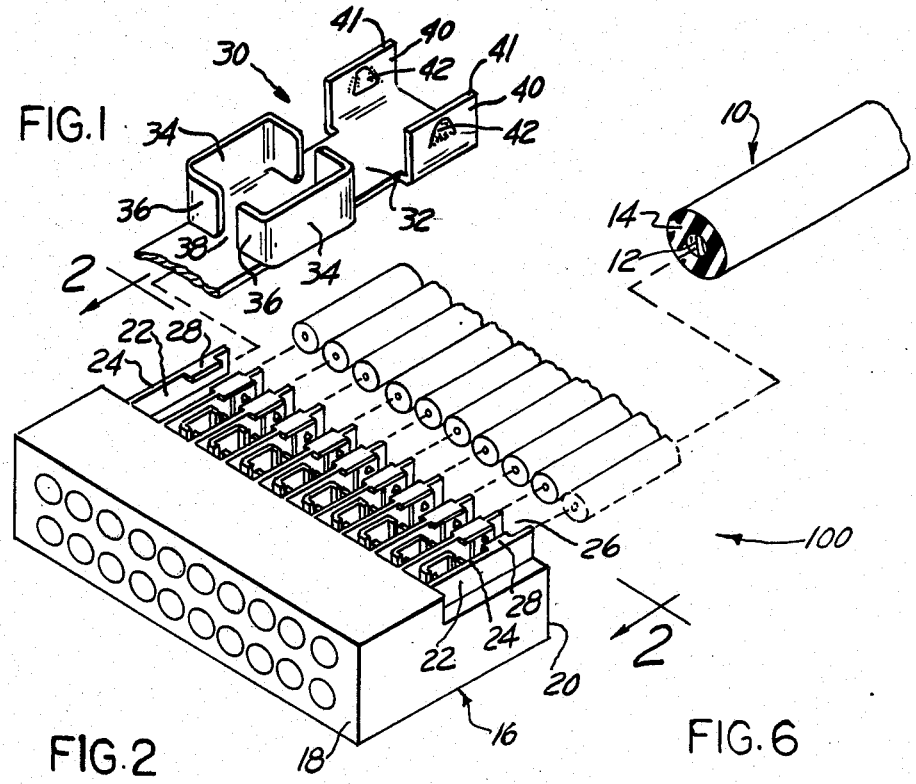
FIG. 1 is an exploded perspective view of the subject electrical connector assembly.

Referring now to the drawings, FIG. 1 illustrates an electrical connector assembly 100 including a housing 16 having a plurality of solderless terminals 30 mounted in the housing each for cutting through the wire insulation 14 of a wire 10 and terminating the respective conductor 12. The housing 16 is an elongated member of rigid plastics having a plurality of terminal passages 26 that are enclosed at the forward end portion of the housing and open onto a mating front face 18 and are open and accessible adjacent the rear face 20, the passages being channel shaped to receive a wire stuffed downwardly therein. Barriers 22 having top edges 24 and inward ledges 28 define the open channels adjacent the rear face.

Each terminal 30 is integrally formed and includes a forward mating end (not shown) which is disposed in the forward end portion of the enclosed housing passage, a U-shaped insulation displacing portion formed by a pair of panels 34 upstanding from a base 32 whereby to define a wire receiving channel therebetween, and an arrangement including a pair of sidewalls 40 for captivating a wire. A flange 36 extends inwardly from the opposite ends of each panel with the opposing pairs of flanges at each end defining an insulation piercing slot 38 therebetween.

Spaced axially rearward from the insulation displacement portion as a continuation of the base 32 is the wire restraint which includes the pair of upstanding longitudinally extending sidewalls 40 each being resiliently connected to the base and having a rib 42 stamped and formed inwardly therefrom, each rib confronting and cooperating to define a constricted throat overhanging the base 32 of the terminal for captivating a longitudinal end portion of the wire inserted therebetween, inward distal end portions of the ribs being spaced apart by an amount less than that defining the outer diameter of the wire received therebetween.

Figure 2:
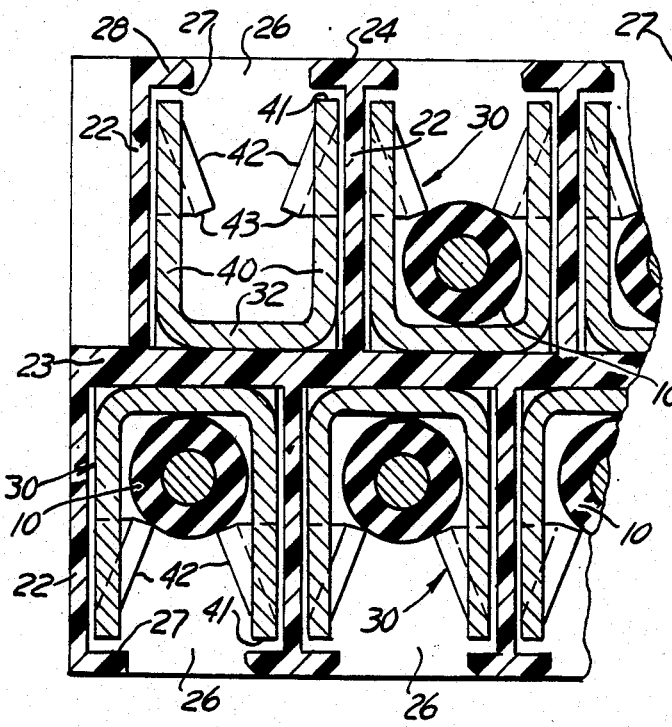
FIG. 2 is an end view in section, such as would be seen taken along lines 2—2 of FIG. 1, of the electrical connector assembly in a fully assembled condition.

FIG. 2 shows, in section, an end view of the housing 16 with a plurality of terminals 30 being disposed in their respective channels and each captivating a wire 10. A pair of open channel shaped portions dispose the wire end portions and their associated terminals in each of two parallel rows, each set of channels upstanding from a common base 23. Each channel portion is U-shaped and comprises the base 23, the barriers 22 extending upwardly from the base with adjacent pairs of respective barriers on the housing forming the channels, and barriers terminating in longitudinal edges 24 and each adjacent confronting pair including an inwardly extending ledge 28.

The wire restraint ribs 42 are stamped and formed from each respective sidewall 40 and extend downwardly and inwardly from the free edge towards the base 32 to form a longitudinal portion 43 which engages the outer periphery of the wire insulation. The top edge 41 of each sidewall 40 is disposed adjacent to the bottom face 27 of its respective ledge 28 to captivate the terminal 30 at the rear end. Each ledge is chamfered to improve the function of the throat for receiving the wire.

Figure 3:
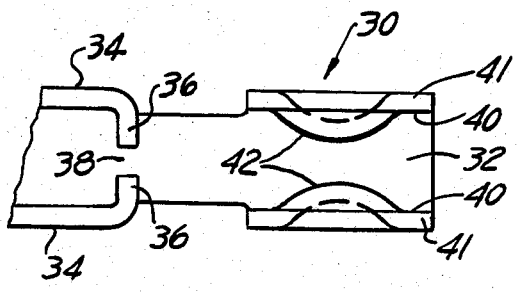
FIGS. 3–5 are, respectively, partial top, partial side, and end views of the solderless terminal of FIG. 1 according to the present invention.
Figure 4:
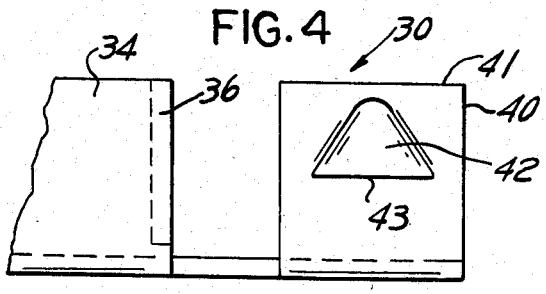
Figure 5:
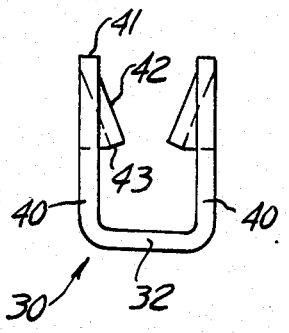

FIGS. 3–5 show additional detail of the terminal 30.

FIG. 3 shows each rib 42 extending inwardly from its respective sidewall 40 and spaced axially from the insulation displacement portion, the ribs forming confronting nose-shaped protuberances.

FIG. 4 shows the rib 42 stamped from its respective sidewall 40 and forming the longitudinal portion 43 facing the base 32 for abutting a longitudinal portion of the wire's outer periphery.

FIG. 5 shows an end view of the terminal 30 and the wire engaging ribs 42 extending towards one another.

Figure 6:
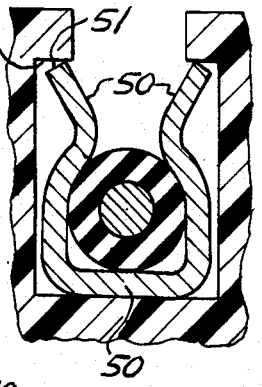
FIG. 6 is a view in section of a solderless terminal captivating a wire.

FIG. 6 shows an alternate wire captivating construction as comprising a pair of sidewalls 50 each extending upwardly from its base 52, reversely bent so as to curve inwardly and outwardly relative to its sidewall to form a Vee-shaped portion with the apex of the two Vees being coplanar and disposed in a plane parallel to the base 52. The inward extension of each Vee forms a wire receiving throat or constriction. The distal longitudinal edges 51 of the sidewalls 50 are adjacent to the downwardly facing surface 27 of the ledge 28 captivating the terminal.

Figure 7:
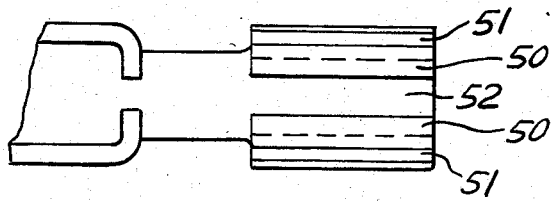
FIGS. 7–9 are, respectively, partial top, partial side, and end views of the solderless terminal shown in FIG. 6.
Figure 8:
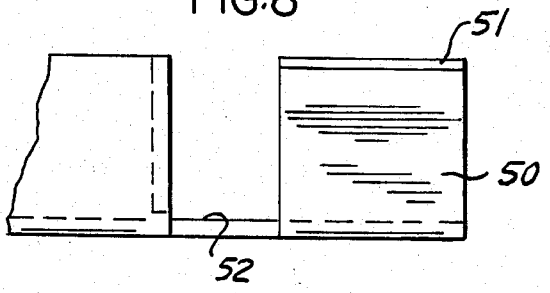
Figure 9:
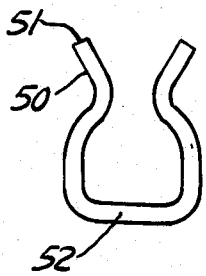

FIGS. 7–9 show additional detail of the terminal shown in FIG. 6. FIGS. 7 and 8 show that the wire captivating portion is longitudinally extending and comprises respective pairs of wire engaging Vee portions, each Vee overhanging the terminal base. FIG. 9 shows the reversely bent Vees.

A wire inserted into the terminal throat passes through the constriction and is resiliently captivated in the recess formed between the base of the terminal and the bottom engagement surface of the wire engaging ribs or Vee portions. The sidewalls are resilient, are not deformed as a result of wire captivation, and cooperate to bias the ribs or Vee portions against the outer periphery of the wire insulation. The sidewalls elastically yield in lateral directions and do not undergo permanent shape change upon receipt or upon removal of a wire. The resiliency of the sidewalls serves to compress the wire engaging ribs or Vee portions into engagement with the wire insulation.

I claim:

1. A solderless terminal for electrically and mechanically terminating an insulated electrical wire, the terminal comprising an insulation displacing portion and characterized by a U-shaped channel including a wire retention portion comprising a wire receiving opening having wire engaging means formed integrally therewith and means to compress said wire engaging means into engagement with a circumferential, longitudinally extending, portion of said wire and to maintain that engagement, the means to compress comprising the channel including a base having a pair of longitudinally extending sidewalls, the wire engaging means comprising a pair of ribs each extending laterally toward the other from one respective sidewall and being substantially nondeformed upon receipt of its respective wire, each said rib being formed by its longitudinal sidewall having been reversely bent so as to form a longitudinally extending, Vee-shaped section with the apex of each Vee being generally in a plane parallel to and spaced from said base.

2. The solderless terminal according to claim 1 wherein the sidewalls are spaced apart by an amount substantially that defined by the outer periphery of said wire and each rib includes an engagement surface which faces the base and which is adapted to engage the outer periphery of the wire.

3. A one-piece sheet metal stamped and formed connecting device performing a mechanical and electrical connection with an elongated insulated electrical wire portion, the device defining a generally U-shaped channel comprising an insulation displacing portion and a wire restraint portion, each said portion being axially spaced from one another and the wire restraint portion being characterized by the channel including a base having a pair of sidewalls upstanding therefrom, each respective sidewall having a first portion resiliently connected to the base and a longitudinally extending Vee-shaped portion which extends laterally inward from its first portion and towards the other sidewall, the Vee shaped portions forming a throat overhanging the base of the device for receiving and guiding the wire downwardly and for captivating the wire portion between the Vee shaped sections and the base, the inward extension of said Vees being such that their apexes are spaced one from the other by an amount less than the outer diameter of the wire portion.

4. An electrical connector mass terminating discrete insulating wires with respective conductive terminals, the conductor including a dielectric housing having a plurality of passages extending in a single row from a rear face through said housing to open on a mating face, each said passage receiving a terminal and being openly accessible and channel-shaped at the rear face remote from the mating face, and each said terminal including an insulation displacement portion and a wire restraint portion characterized by the accessible portion of the channel being defined by a pair of barriers each having a ledge adjacent its top edge and each terminal being U-shaped for interference fitment within its respective passage and including a base and a pair of sidewalls each being laterally spaced by a distance substantially equal to the outside diameter of the wire, each sidewall depending from the base and terminating in a longitudinal edge adjacent to the bottom face of one respective ledge, a Vee shaped section extending laterally inward from each sidewall each Vee section having, respectively, a first and a second portion each converging towards the other and to its apex, the apexes from each said section being laterally spaced apart by a distance less than the outside diameter of the wire, the Vee sections cooperating to form a constriction overhanging the base for captivating its respective wire.

5. The connector as recited in claim 4 including a second plurality of like passages being disposed in a respective row.

* * * * *